US006476696B1

(12) United States Patent
Mack

(10) Patent No.: US 6,476,696 B1
(45) Date of Patent: Nov. 5, 2002

(54) WAVEGUIDE FOR MICROWAVE MANIPULATION

(76) Inventor: Paul P. Mack, 25 Shipley Crescent, Stittsville, Ontario (CA), K2S 1R2

( * ) Notice: Subject to any disclaimer, the term of this patent is extended or adjusted under 35 U.S.C. 154(b) by 0 days.

(21) Appl. No.: 09/685,213

(22) Filed: Oct. 11, 2000

(30) Foreign Application Priority Data

Oct. 2, 2000 (CA) ..... 2322334

(51) Int. Cl.[7] ..... H01P 1/18; H01P 1/00; H01P 1/20; H01P 3/00; H01D 1/16

(52) U.S. Cl. ..... 333/248; 333/157; 333/208; 333/239; 333/251

(58) Field of Search ..... 333/248, 208, 333/212, 251, 239, 157

(56) References Cited

U.S. PATENT DOCUMENTS 2,772,400 A * 11/1956 Simmons ..... 333/21 R
3,046,503 A * 7/1962 Cohn ..... 333/210

* cited by examiner

*Primary Examiner*—Robert Pascal
*Assistant Examiner*—Kimberly Glenn
(74) *Attorney, Agent, or Firm*—Freedman & Associates

(57) ABSTRACT

This invention relates to the design of a microwave component utilizing geometric shapes positioned within the channel of a waveguide structure so as to produce microwave manipulation characteristics, with associated near and far fields, whereby predetermined performance requirements may be satisfied.

3 Claims, 6 Drawing Sheets

(SECTION A-A)

(SECTION B-B)

(SECTION C-C)

(SECTION D-D)

(EXPLODED VIEW)

(CROSS SECTION THRU COMPONENT)

WAVEGUIDE FOR MICROWAVE MANIPULATION

FIELD OF THE INVENTION

This invention relates to the design of microwave components and, in particular, to designs which incorporate geometrically-shaped elements within a waveguide structure and utilize the microwave manipulation characteristics associated therewith, and production of primary (near) and secondary (far) fields, to satisfy specified performance requirements.

BACKGROUND OF THE INVENTION

Present waveguide design techniques rely on the fields generated by physical attributes such as internal contours and slot arrays but these physical attributes are difficult to control by reason of limiting manufacturing tolerances, operational variations, environmental changes and the target performance requirements. As a result, the present devices have associated with them undesirable performance losses and costs.

SUMMARY OF THE INVENTION

In accordance with the invention there is provided a microwave component configured for satisfying predetermined performance characteristics. A channel is provided and one or more geometrically-shaped elements are positioned within the channel, wherein the number, dimensions and spacing of the elements determine the performance characteristics of the waveguide.

BRIEF DESCRIPTION OF THE DRAWINGS

Reference will now be made to the accompanying drawings which illustrate the present invention and in which like reference numerals refer to like elements throughout.

DETAILED DESCRIPTION OF THE ILLUSTRATED PREFERRED EMBODIMENT

Figure 1A:
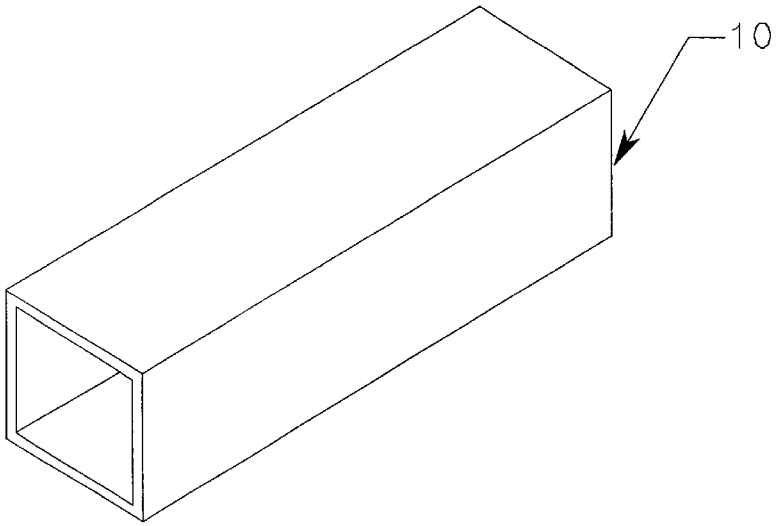
FIGURE 1(a) (PRIOR ART)
FIGS. 1(*a*) and 1(*b*) illustrate a prior art waveguide, FIG. 1(*a*) being a perspective view thereof and FIG. 1(*b*) being a side cross-sectional view of the prior art waveguide of FIG. 1(*a*)
Figure 1B:
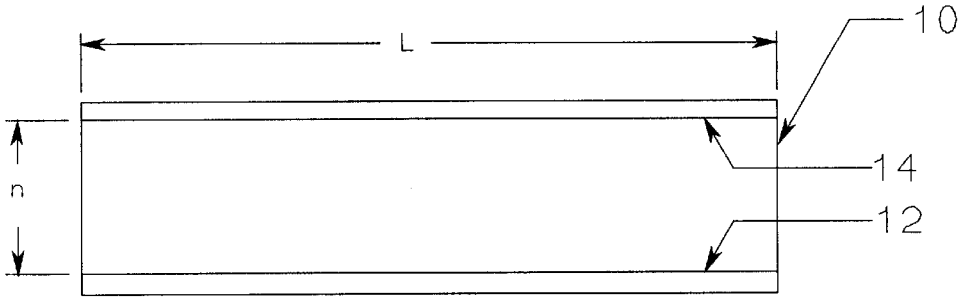
FIGURE 1(b) (PRIOR ART)
Figure 2:
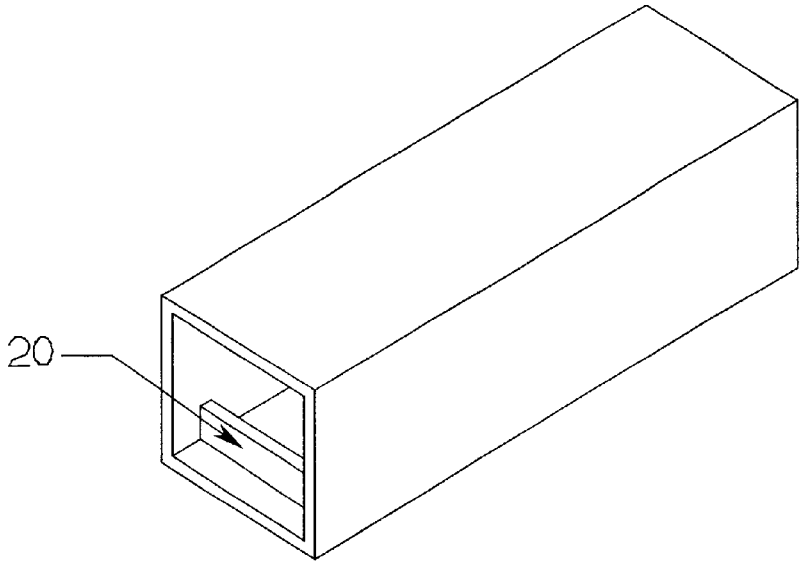
FIGS. 2(*a*) and 2(*b*) illustrate an exemplary waveguide in accordance with the present invention, FIG. 2(*a*) being a perspective view thereof and FIG. 2(*b*) being a side cross-sectional view of the waveguide of FIG. 2(*a*)
Figure 2:
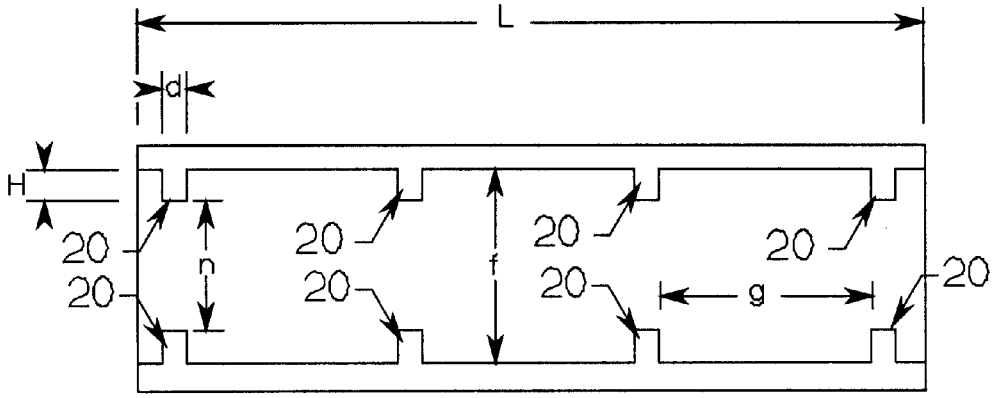
Figure 3:
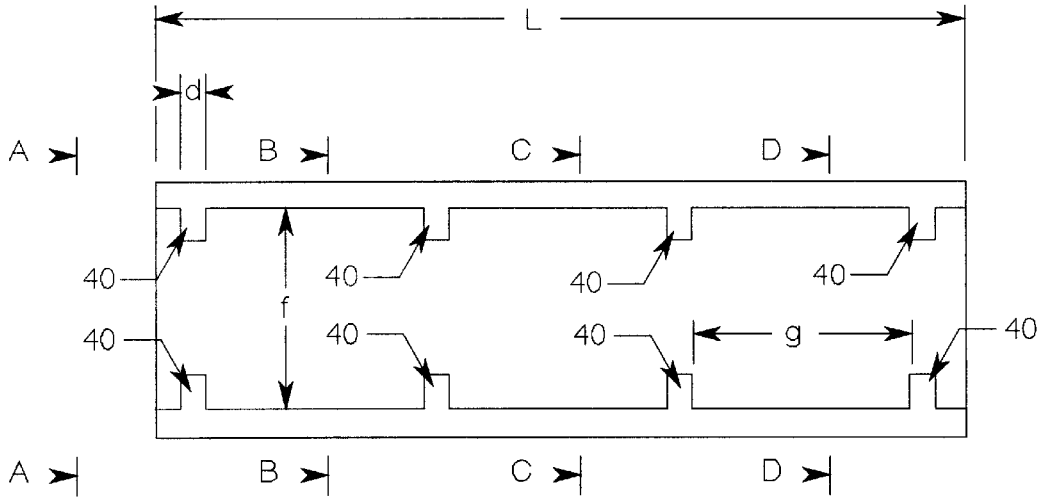
FIGS. 3(*a*)–(*e*) illustrate another exemplary waveguide in accordance with the present invention, FIG. 3(*a*) showing a side cross-sectional view of the waveguide and FIGS. 3(*b*), (*c*), (*d*) and (*e*) showing front cross-sectional views taken at sections A—A, B—B, C—C and D—D, respectively; and, FIGS. 4(*a*) and 4(*b*) illustrates another exemplary waveguide in accordance with the present invention, FIG. 4(*a*) being a fragmented perspective view thereof (showing separated top and bottom halves one over the other) and FIG. 4(*b*) being a side cross-sectional view of the waveguide of FIG. 4(*a*) (but with the top and bottom halves joined together).
Figure 3:
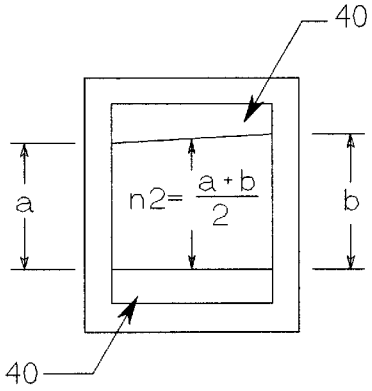
Figure 3:
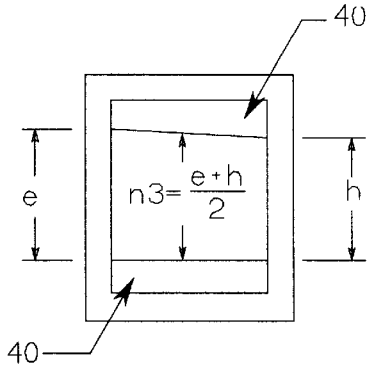
Figure 3:
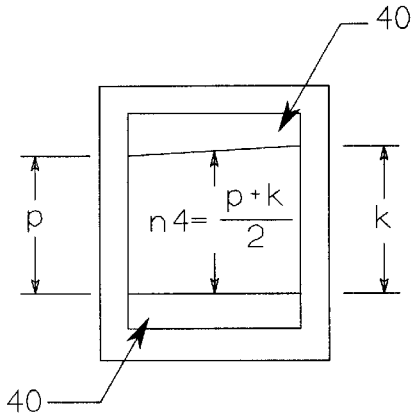
Figure 3:
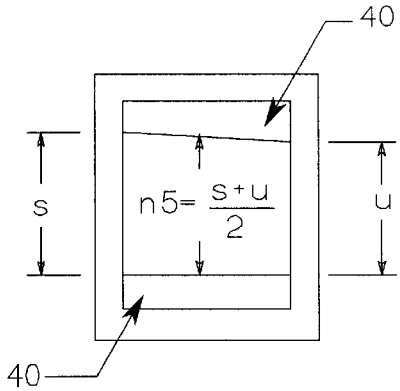
Figure 4:
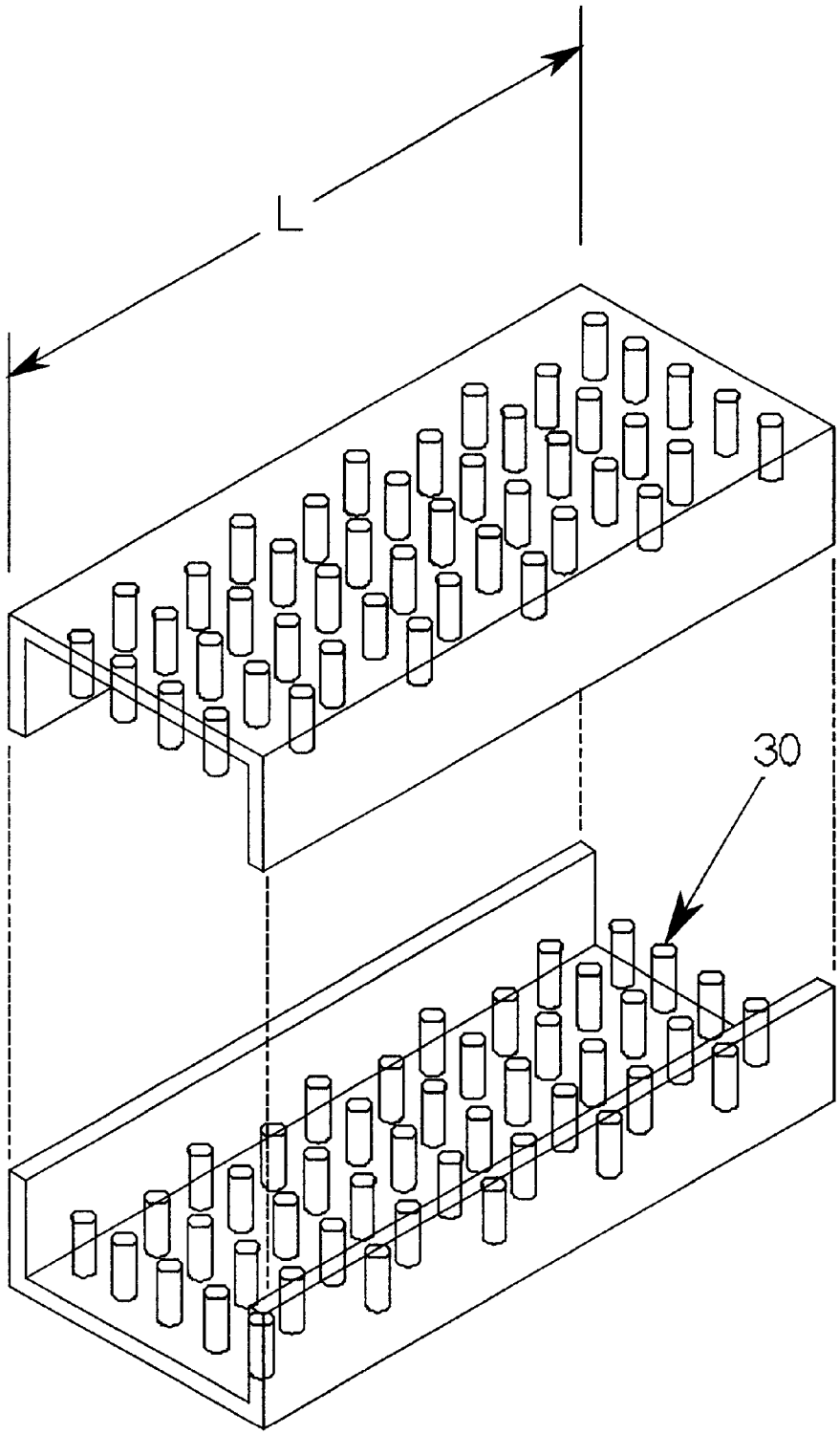
Figure 4:
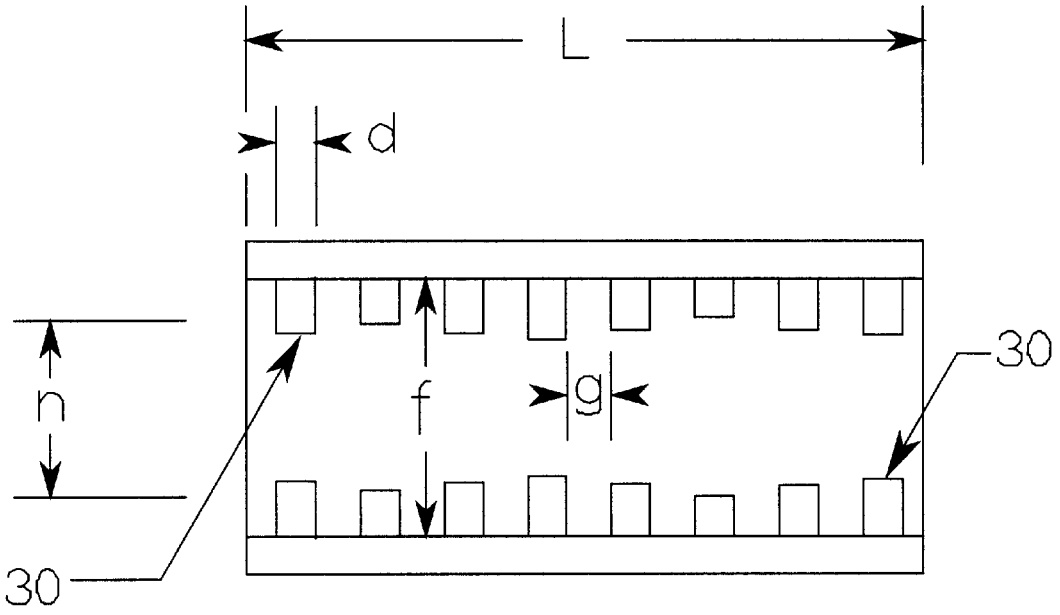

FIGS. 1(*a*) and 1(*b*) illustrate a prior art waveguide, FIG. 1(*a*) being a perspective view thereof and FIG. 1(*b*) being a side cross-sectional view of the prior art waveguide of FIG. 1(*a*);

FIGS. 2(*a*) and 2(*b*) illustrate an exemplary waveguide in accordance with the present invention, FIG. 2(*a*) being a perspective view thereof and FIG. 2(*b*) being a side cross-sectional view of the waveguide of FIG. 2(*a*);

FIGS. 3(*a*)–(*e*) illustrate another exemplary waveguide in accordance with the present invention, FIG. 3(*a*) showing a side cross-sectional view of the waveguide and FIGS. 3(*b*), (*c*), (*d*) and (*e*) showing front cross-sectional views taken at sections A—A, B—B, C—C and D—D, respectively; and, FIGS. 4(*a*) and 4(*b*) illustrates another exemplary waveguide in accordance with the present invention, FIG. 4(*a*) being a fragmented perspective view thereof (showing separated top and bottom halves one over the other) and FIG. 4(*b*) being a side cross-sectional view of the waveguide of FIG. 4(*a*) (but with the top and bottom halves joined together).

FIGS. 3(*a*)–(*e*) show a more complex waveguide in accordance with this invention in which a bar-shaped element 40 is incorporated into the waveguide channel at space intervals along the top and bottom sides of the waveguide channel and the height h of one set of these (being the upper elements in these figures) varies across its width as shown by FIG. 3(*a*), with adjacent bar elements having a similar varying height but wherein the height increases/decreases in alternating directions in each adjacent bar element as illustrated by FIGS. 3(*b*)–(*e*). This varies the near field and field response is determined as a result of an averaging of the primary field and associated fields whereby there is no longer any need that these elements be located precisely within the waveguide.

FIGS. 4(*a*) and 4(*b*) show a more complex waveguide in accordance with the invention in which pin-shape elements 30 are used as the geometric shape and are located in a random manner along the top and bottom sides of the waveguide channel. Because the pin arrangement is random this waveguide configuration achieves both the loss reduction provided by the simple waveguide of FIGS. 2(*a*) and (*b*) and the field response averaging advantage provided by the waveguide of FIGS. 3(*a*)–(*e*) as well as other advantages.

The foregoing benefits provided by this invention may be obtained at most microwave frequencies and are most substantial at higher frequencies (i.e. above 4 GHz).

It is to be understood that the particular embodiments described herein, by way of illustration, are not intended to limit the scope of the invention claimed by the inventor which is defined by the appended claims. In particular, it is to be understood that the invention is not limited to any particular element shapes and although the illustrated embodiments show the use of geometrically shaped elements along both the top and bottom sides of the microwave component it may be satisfactory, depending upon the application, to position such elements along one side only.

What is claimed is:

1. A microwave component configured for satisfying predetermined performance characteristics and comprising:

a channel;

a plurality of geometrically-shaped elements having varying dimensions and producing a field response on the basis of an averaging of dimensional effects, positioned in spaced relationship within said channel, and the dimensions of said channel relative to the dimensions of said element, number, dimensions and spacing of said elements determine said performance characteristics;

said elements being bar shaped and an adjacent set of said elements having a height which increases from one end to the other of said element, with each adjacent element having its height increase in an alternating direction relative to that of the elements adjacent thereto.

2. A method for making a microwave component which satisfies predetermined performance characteristics, said method comprising providing a waveguide having a channel therein and positioning in spaced relationship within said channel a plurality of geometrically-shaped elements wherein said elements are bar shaped and an adjacent set of said elements have a height which increases from one end to the other end of said element, each adjacent element having its height increase in an alternating direction relative to that of the elements adjacent thereto, whereby the dimensions of said channel relative to said element the number, dimensions and spacing of said elements determine said performance characteristics.

3. A microwave component configured for satisfying predetermined performance characteristics and comprising a channel wherein at least one geometrically-shaped element is bar shaped, having a height which increases from one end to the other end of said element, is positioned within said channel and the dimensions of said channel relative to the dimensions and position of the said element determine said performance characteristics.

* * * * *